US010438534B2

(12) United States Patent
Yan et al.

(10) Patent No.: US 10,438,534 B2
(45) **Date of Patent: *Oct. 8, 2019**

(54) DISPLAY MODULE DRIVING DEVICE AND METHOD

(71) Applicant: Wuhan China Star Optoelectronics Technology Co., Ltd., Wuhan, Hubei (CN)

(72) Inventors: Weinan Yan, Guangdong (CN); Fu-Chih Chang, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/261,723

(22) Filed: Jan. 30, 2019

(65) Prior Publication Data

US 2019/0156745 A1 May 23, 2019

Related U.S. Application Data

(63) Continuation of application No. 15/544,013, filed on Jul. 16, 2017, now Pat. No. 10,360,850.

(51) Int. Cl.
*G09G 3/32* (2016.01)
*G09G 3/3233* (2016.01)

(52) U.S. Cl.
CPC ... *G09G 3/3233* (2013.01); *G09G 2320/0233* (2013.01); *G09G 2320/0285* (2013.01);
(Continued)

(58) Field of Classification Search
CPC ..... G09G 2360/16; G09G 2320/0626; G09G 2320/0646; G09G 3/3406; G09G 3/3208;
(Continued)

(56) References Cited

U.S. PATENT DOCUMENTS 7,859,494 B2 * 12/2010 Choi ..... G09G 3/3233 345/207
9,881,554 B2 * 1/2018 Meng ..... G09G 3/3258
(Continued)

FOREIGN PATENT DOCUMENTS

CN 1591549 A 3/2005
CN 1797522 A 7/2006
(Continued)

OTHER PUBLICATIONS

2017100519623, First Office Action.
PCTCN2017082293, International Search Report.

*Primary Examiner* — Duc Q Dinh
(74) *Attorney, Agent, or Firm* — Andrew C. Cheng

(57) ABSTRACT

Disclosed is a display module driving device, comprising a display driving module, driving each of the organic light emitting diodes to emit light; a plurality of light sensors, detecting brightnesses of corresponding light sensors and outputting corresponding actual brightness values; a gray scale brightness conversion module, acquiring a gray scale value of each of the sub pixels in a present display frame and converting the gray scale value into a corresponding target brightness value; a comparing module, receiving and comparing the target brightness value and the corresponding actual brightness value of each of the sub pixels; and a controlling module, controlling the display driving module to drive the organic light emitting diodes to maintain the target brightness value as the actual brightness value is equal to the target brightness value. The display module driving device can effectively solve the problem of the display difference caused by the uneven brightness.

8 Claims, 2 Drawing Sheets

(52) U.S. Cl.
CPC ..... *G09G 2320/0626* (2013.01); *G09G 2360/141* (2013.01); *G09G 2360/142* (2013.01); *G09G 2360/145* (2013.01)

(58) Field of Classification Search
CPC ..... G09G 2300/0861; G09G 5/10; G09G 2320/0223; G09G 2320/0271; G09G 2320/043; G09G 3/006; G09G 2300/0439; G09G 2310/0278; G09G 2320/066; G09G 2320/0233; G09G 3/325; G09G 3/3413; G09G 3/3233; G09G 2320/0285; G09G 2360/145; G09G 2360/141; G09G 2360/142
See application file for complete search history.

(56) References Cited

U.S. PATENT DOCUMENTS

| | | | | |
|---|---|---|---|---|
| 2004/0070558 | A1 | 4/2004 | Cok | |
| 2005/0179625 | A1 | 8/2005 | Choi | |
| 2016/0321987 | A1 | 11/2016 | Oh | |
| 2018/0082660 | A1* | 3/2018 | Xu | G09G 3/3208 |

FOREIGN PATENT DOCUMENTS

| | | | |
|---|---|---|---|
| CN | 1826627 | A | 8/2006 |
| CN | 1908748 | A | 2/2007 |
| CN | 101014991 | A | 8/2007 |
| CN | 101251983 | A | 8/2008 |
| CN | 104157237 | A | 11/2014 |
| CN | 106297679 | A | 1/2017 |
| CN | 106531081 | A | 3/2017 |

* cited by examiner

DISPLAY MODULE DRIVING DEVICE AND METHOD

CROSS REFERENCE

This is a continuation application of co-pending U.S. patent application Ser. No. 15/544,013 filed on Jul. 16, 2017, which is a national stage of PCT Application No. PCT/CN2017/082293, filed on Apr. 27, 2017, claiming foreign priority of Chinese Patent Application No. 201710051962.3, entitled "Display module driving device and method", filed on Jan. 23, 2017, the disclosure of which is incorporated herein by reference in its entirety.

FIELD OF THE INVENTION

The present invention relates to a display technology field, and more particularly to a display module driving device and a method.

BACKGROUND OF THE INVENTION

The organic light-emitting diode (OLED) has been increasingly used as a high-performance display as a current-emitting device. The traditional passive matrix organic light emitting diode (Passive Matrix OLED, PMOLED) display needs a shorter single pixel drive time as the display size increases, thus needs to increase the transient current to increase power consumption. Meanwhile, the large current application will cause the overlarge voltage drop on the ITO line to result in that the OLED operating voltage is too high, thereby reducing the efficiency. The active matrix organic light emitting diode (Active Matrix OLED, AMOLED) display progressively inputs OLED current through the switch lines row by row and can solve these problems well.

However, the AMOLED display technology still possesses more obvious defects. Since the panel manufacture is not uniform, the threshold voltage, mobility and other electrical parameters of the respective driving thin film transistors are nonuniform. This nonuniformity will be converted into the current difference and the brightness difference between the OLEDs to result in uneven brightness among pixels and display differences. Although some of the compensation skills solve the influence of the threshold voltage, the cost is a complex compensation circuit to reduce the aperture rate of the pixel. The evaporation process in the panel manufacturing process leads to the property differences among the sub-pixels, such as differences of the cross-voltage and the luminous efficiency of the OLEDs or the luminous efficiency attenuation caused by the OLED device aging similarly causes the display differences among the pixels.

SUMMARY OF THE INVENTION

The embodiment of the present invention provides a display module driving device to solve the problem of the display difference caused by the uneven brightness of the display module pixels.

Disclosed is a display module driving device, used for driving a display module, the display mode comprising a plurality of sub pixels and each of the sub pixels comprising an organic light emitting diode, wherein the display module driving device comprises:

a display driving module, driving each of the organic light emitting diodes to emit light;

a brightness detecting module, having a plurality of light sensors, each of the light sensors detecting a brightness of a corresponding organic light emitting diode and outputting a corresponding actual brightness value;

a gray scale brightness conversion module, acquiring a gray scale value of each of the sub pixels in a present display frame and converting the gray scale value into a corresponding target brightness value;

a comparing module, receiving and comparing the target brightness value and the corresponding actual brightness value of each of the sub pixels; and a controlling module, controlling the display driving module to drive the organic light emitting diodes to maintain the target brightness value as the actual brightness value is equal to the target brightness value.

The embodiment of the present invention further provides a display driving method, used for driving a display module, the display mode comprising a plurality of sub pixels and each of the sub pixels comprising an organic light emitting diode, wherein the display module driving method comprises steps of:

driving each of the organic light emitting diodes to emit light;

detecting a brightness of each of the organic light emitting diodes and outputting a corresponding actual brightness value;

acquiring a gray scale value of each of the sub pixels in a present display frame and converting the gray scale value into a corresponding target brightness value;

comparing the target brightness value and the corresponding actual brightness value of each of the sub pixels; and controlling the organic light emitting diodes to maintain the target brightness value as the actual brightness value is equal to the target brightness value.

The display module driving device and the display driving method provided by the present invention drive the organic light emitting diode of each sub pixel for working to reach the target brightness and monitor the brightness of each organic light emitting diode in real time. The organic light emitting diode can maintain the current target brightness as reaching the reach the target brightness so that the respective organic light emitting diodes all reach the target brightness to ensure the even brightness of the present display frame. Meanwhile, the brightness of the organic light emitting diode is monitored and controlled directly to avoid the complicated compensation circuit without gamma correction to simplify the circuit structure.

BRIEF DESCRIPTION OF THE DRAWINGS

In order to more clearly illustrate the embodiments of the present invention, the following figures will be described in the embodiments are briefly introduced. It is obvious that the drawings are some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Figure 1:
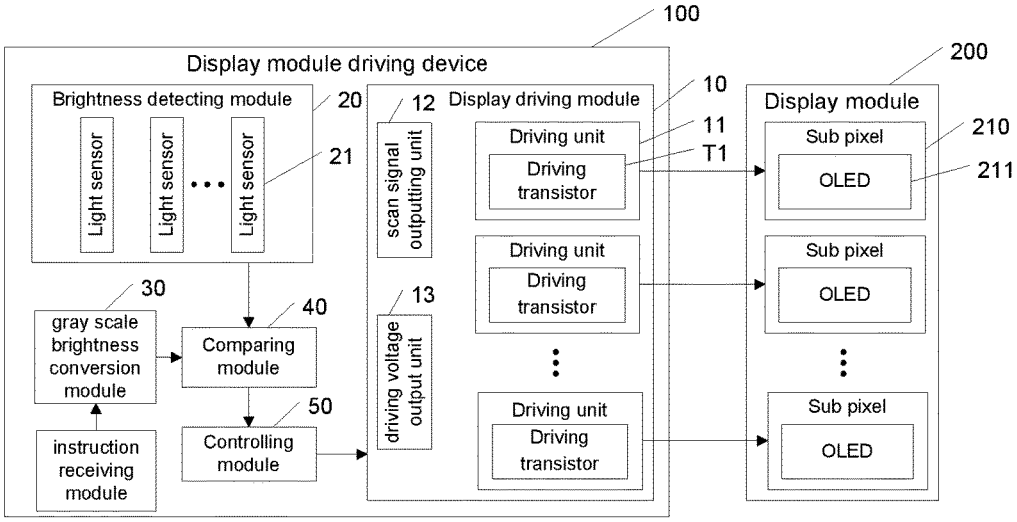
FIG. 1 is a function module diagram of a display module driving device provided by the preferred embodiment of the present invention.

Please refer to FIG. 1, which is a function module diagram of a display module driving device 100 provided by the preferred embodiment of the present invention. As shown in figure, the display module driving device 100 is used for driving a display module 200. The display mode 200 comprises a plurality of sub pixels 210 and each of the sub pixels 210 comprises an organic light emitting diode (OLED) 211.

The display module driving device 100 can comprises:

a display driving module 10, driving each of the organic light emitting diodes 211 to emit light;

a brightness detecting module 20, having a plurality of light sensors 21, each of the light sensors 21 detecting a brightness of a corresponding OLED 211 and outputting a corresponding actual brightness value, wherein specifically, the light sensor 21 can be a photosensitive sensor, which converts the light signal into the electrical signal and determines the actual brightness value by according to the electrical signal, for instance, the light sensor 21 can look up a corresponding brightness value in a pre-stored lookup table. The electrical signal can be a voltage signal or a current signal;

a gray scale brightness conversion module 30, acquiring a gray scale value of each of the sub pixels 210 in a present display frame and converting the gray scale value into a corresponding target brightness value;

a comparing module 40, receiving and comparing the target brightness value and the corresponding actual brightness value of each of the sub pixels 210;

a controlling module 50, controlling the display driving module 10 to drive the OLED 211 to maintain the target brightness value as the actual brightness value is equal to the target brightness value.

Then, the display driving module 10 of the display module driving device 100 drives the OLED 211 of each sub pixel 210 for working to reach the target brightness and monitor the brightness of each OLED 211 in real time. The OLED 211 can maintain the current target brightness as reaching the reach the target brightness so that the respective OLEDs 211 all reach the target brightness to ensure the even brightness of the present display frame. Meanwhile, the brightness of the OLED 211 is monitored and controlled directly to avoid the complicated compensation circuit without gamma correction to simplify the circuit structure.

Specifically, the gray scale brightness conversion module 30 converts the acquired gray scale value into a corresponding target brightness value according to a following formula:

$$L_x = L_{max} \cdot \left(\frac{x}{255}\right)^{2.2}$$

wherein x represents the gray scale value, $L_{max}$ is a preset value, $L_x$ represents the target brightness value.

The value of $L_{max}$ can be changed to adjust the entire brightness of the display mode 200. Specifically, the display module can receive a brightness adjusting instruction via an instruction receiving module and control the gray scale brightness conversion module 30 according to the instruction to change the value of $L_{max}$. For instance, the brightness adjusting instruction can be automatically issued by the controlling module 50 or other controller according to the actual display demands. The brightness adjusting instruction can be issued by the user, manually. For instance, the user can issue the adjusting instruction by operating a physical key or by operating a touch screen.

Furthermore, the display driving module 10 specifically comprises:

a plurality of driving units 11, each of the driving units 11 having a driving transistor T1, the driving transistor T1 driving the OLED 211 to emit light;

a scan signal outputting unit 12, electrically coupled to the driving transistor T1 to output a periodic scan signal SCAN, the periodic scan signal SCAN controlling a duration that the OLED 211 maintains the target brightness value; and a driving voltage outputting unit 13, electrically coupled to the driving transistor T1 to output a driving voltage Vcharge which varies periodically with the scan signal to a gate of the driving transistor T1, the driving voltage Vcharge controlling the driving transistor T1 to drive the OLED 211 to gradually light up or gradually extinguish.

The controlling module 50 turns off an electrical connection of the driving voltage outputting unit 13 and each of the driving transistors T1 as the actual brightness value is equal to the target brightness value and recovers the electrical connection of the driving voltage outputting unit 13 and the driving transistors T1 as a period of the scan signal SCAN is finished.

Figure 2:
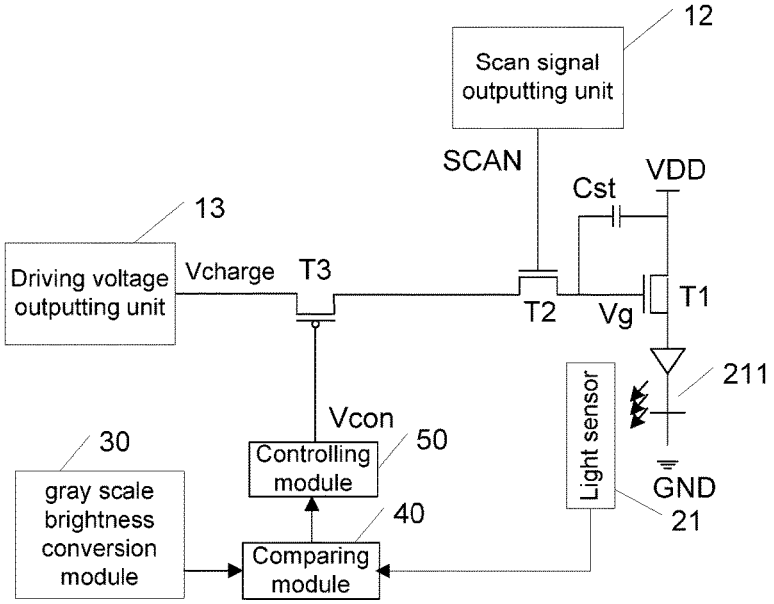
FIG. 2 is a circuit diagram of the display module driving device shown in FIG. 1.

Specifically, refer to FIG. 2, which is a circuit diagram of the display module driving device 100 according to the preferred embodiment of the present invention. As shown in figure, each driving unit 11 specifically comprises a driving transistor T1, a switching transistor T2, a switching transistor T3 and a charging capacitor Cst. A power supply voltage VDD is electrically coupled to the OLED 211 via the driving transistor T1. A control end of the driving transistor T1 is electrically coupled to the driving voltage outputting unit 13 via the switching transistor T2 and the switching transistor T3 in order. A control end of the switching transistor T2 is electrically coupled to the scan signal outputting unit 12. A control end of the switching transistor T3 is electrically coupled to the controlling module 50. The controlling module 50 controls the switching status of the switching transistor T3 with a control signal Vcon. The charging capacitor Cst is electrically coupled between the power supply voltage VDD and the control end of the driving transistor T1.

Figure 3:
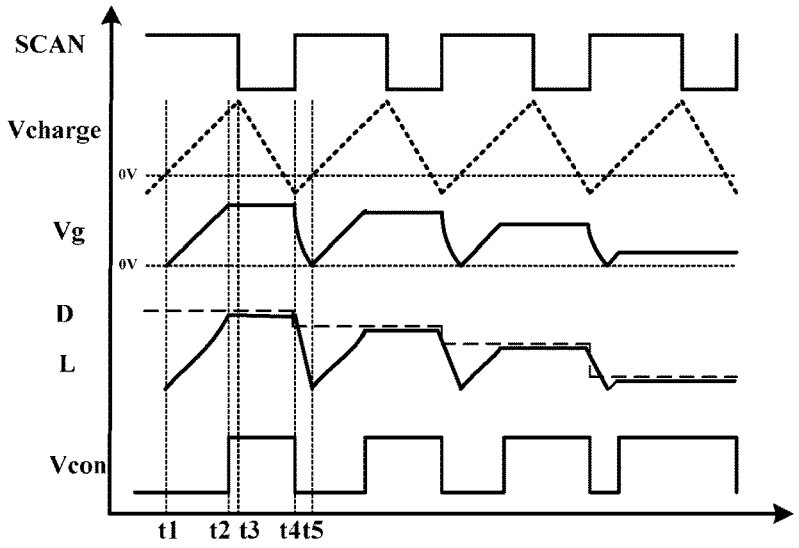
FIG. 3 is a sequence diagram of respective signals of the display module driving device shown in FIG. 2.

Please refer to FIG. 3, which is a sequence diagram of respective signals of the display module driving device 100 according to the preferred embodiment of the present invention. As shown in FIG. 3, the scan signal SCAN is a square wave of periodic change. The driving voltage Vcharge is a triangular wave varying with the scan signal SCAN. The driving voltage Vcharge is in a range of (−a, b), wherein a and b are positive integers. Namely, the value of the driving voltage Vcharge is negative for a partial period in one cycle. In FIG. 3, Vg represents a control end voltage of the driving transistor T1, i.e. a gate voltage. D represents a target brightness value converted by the gray scale brightness conversion module 30. L represents an actual brightness detected by the light sensor 21.

The operation of the display module driving device 100 is described in detail below.

At time t1, the scan signal SCAN is on. The gray scale brightness conversion module 30 acquires a gray scale value of each of the sub pixels 210 in a present display frame and converts the gray scale value into a corresponding target brightness value D. At this time, the switching transistor T2 and the switching transistor T3 are in the closed status. The gate voltage Vg of the driving transistor T1 is the driving voltage Vcharge. Meanwhile, the driving voltage Vcharge charges the charging capacitor Cst. The driving transistor T1 enables the current of the power supply voltage VDD flowing through the OLED 211 to drive the OLED 211 to emit light under control of the driving voltage Vcharge. As the gate voltage Vg of the driving transistor T1 gradually increases, the brightness of the OLED 211 gradually increases. Meanwhile, the light sensor 21 detects the actual brightness of the OLED 211 and the actual brightness value L is fed back to the comparing module 40 to be compared with the target brightness value D.

At time t2, as the actual brightness value L of the OLED 211 reaches the target brightness value D, the comparing module 40 drives the controlling module 50 to flip the control signal Vcon outputted therefrom and controls the switching transistor T3 to be turned off to cut the electrical connection between the voltage outputting unit 13 and the driving transistor T1. Then, the charging capacitor Cst is discharged to maintain the gate voltage Vg of the driving transistor T1 at the present voltage level to maintain the OLED 211 at the current brightness. Since the scan signal SCAN has not flipped yet at this moment, the driving voltage Vcharge keeps increasing until time t3. However, the switching transistor T3 remains in the off status and then the gate voltage Vg of the driving transistor T1 and the brightness of the OLED 211 remain unchanged.

At time t3, the scan signal SCAN is flipped to turn off the switching transistor T2. The driving voltage Vcharge is flipped and gradually decreases from the maximum voltage level. Similarly, since the switching transistor T3 remains in the off status and then the gate voltage Vg of the driving transistor T1 and the brightness of the OLED 211 remain unchanged.

At time t4, the scan signal SCAN enters the next period and is flipped to control the switching transistor T2 to be turned off. Then, the control signal Vcon outputted by the controlling module 50 is flipped correspondingly to control the switching transistor T3 to be closed to recover the electrical connection between the voltage outputting unit 13 and the driving transistor T1. Since the driving voltage Vcharge is negative at this time, the charging capacitor Cst is quickly discharged so that the brightness of the OLED 211 is rapidly reduced. Besides, as the scan signal SCAN enters the next period or before that, the gray scale brightness conversion module 30 will acquire the gray scale value of the new display frame and convert the gray scale value into the new target brightness value D corresponding thereto.

At the time t5, the driving voltage Vcharge is changed to be positive and re-drives the OLED 211 to emit light for entering the next display period.

The display driving module 10 of the display module driving device 100 according to the preferred embodiment of the present invention drives the OLED 211 of each sub pixel 210 for working to reach the target brightness and monitor the brightness of each OLED 211 in real time. The OLED 211 can maintain the current target brightness as reaching the reach the target brightness so that the respective OLEDs 211 all reach the target brightness to ensure the even brightness of the present display frame. Meanwhile, the brightness of the OLED 211 is monitored and controlled directly to avoid the complicated compensation circuit without gamma correction to simplify the circuit structure. In addition, if the NMOS/PMOS type of the foregoing transistor changed, the corresponding gate control voltage also will be changed.

Figure 4:
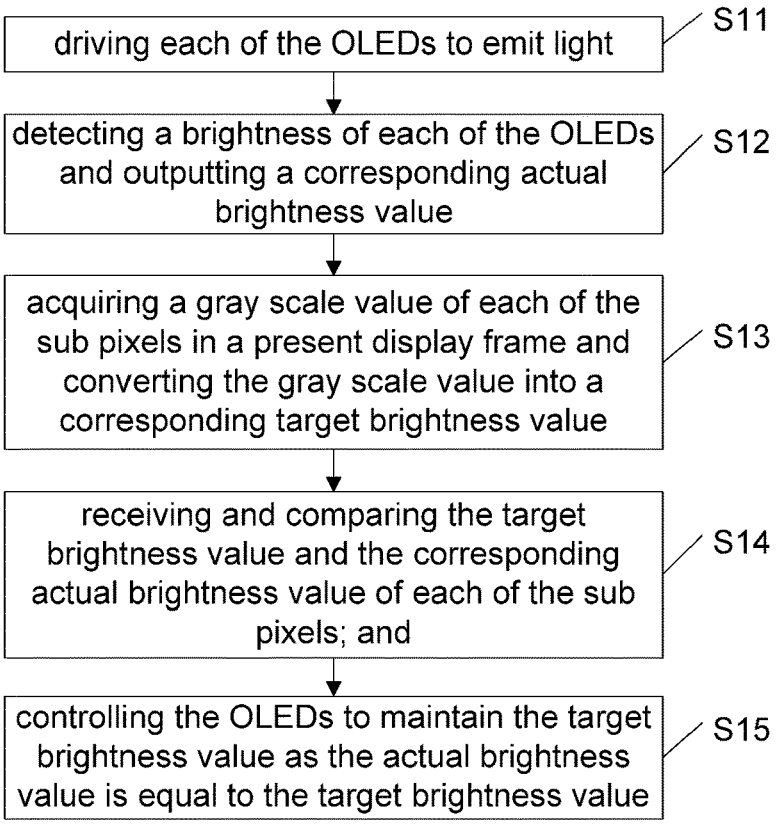
FIG. 4 is a flowchart of a display driving method provided by the preferred embodiment of the present invention.

Please refer to FIG. 4, which is a flowchart of a display driving method provided by the preferred embodiment of the present invention. The display driving method can be applied to the aforesaid display module driving device 100 for driving the display mode 200. The display mode 200 comprises a plurality of sub pixels 210 and each of the sub pixels 210 comprises an OLED 211. The method can comprise steps S11-S15.

S11, driving each of the OLEDs 211 to emit light.

Specifically, each of the OLEDs 211 is driven by a driving transistor T1. By providing a periodic scan signal SCAN and a driving voltage Vcharge which varies periodically with the scan signal to the driving transistor T1, the driving transistor T1 is controlled to drive the OLED 211 to gradually light up or gradually extinguish with the driving voltage Vcharge. The scan signal SCAN is a square wave of periodic change. The driving voltage Vcharge is a triangular wave varying with the scan signal SCAN. The driving voltage Vcharge is in a range of (−a, b), wherein a and b are positive integers. Namely, the value of the driving voltage Vcharge is negative for a partial period in one cycle.

S12, detecting a brightness of each of the OLEDs 211 and outputting a corresponding actual brightness value.

Specifically, the light signal can be converted into the electrical signal to determine the actual brightness value by according to the electrical signal. For instance, a corresponding brightness value can be looked up in a pre-stored lookup table. The electrical signal can be a voltage signal or a current signal.

S13, acquiring a gray scale value of each of the sub pixels 210 in a present display frame and converting the gray scale value into a corresponding target brightness value.

Specifically, the acquired gray scale value can be converted into a corresponding target brightness value according to a following formula:

$$L_x = L_{max} \cdot \left(\frac{x}{255}\right)^{2.2}$$

wherein x represents the gray scale value, $L_{max}$ is a preset value, $L_x$ represents the target brightness value.

The value of $L_{max}$ can be changed to adjust the entire brightness of the display mode 200. Specifically, a brightness adjusting instruction is received to change a value of $L_{max}$ according to the brightness adjusting instruction. For instance, the brightness adjusting instruction can be automatically issued by other controller according to the actual display demands. The brightness adjusting instruction can be issued by the user, manually. For instance, the user can issue the adjusting instruction by operating a physical key or by operating a touch screen.

S14, receiving and comparing the target brightness value and the corresponding actual brightness value of each of the sub pixels 210.

S15, controlling the OLEDs 211 to maintain the target brightness value as the actual brightness value is equal to the target brightness value.

Specifically, an electrical connection of the driving voltage Vcharge and the driving transistor is turned off as the actual brightness value is equal to the target brightness value.

The electrical connection of the driving voltage Vcharge and the driving transistor is recovered as a period of the scan signal is finished.

Then, the display driving method drives the OLED 211 of each sub pixel 210 for working to reach the target brightness and monitor the brightness of each OLED 211 in real time. The OLED 211 can maintain the current target brightness as reaching the reach the target brightness so that the respective OLEDs 211 all reach the target brightness to ensure the even brightness of the present display frame. Meanwhile, the brightness of the OLED 211 is monitored and controlled directly to avoid the complicated compensation circuit without gamma correction to simplify the circuit structure.

Those skilled in the art will appreciate that the units and algorithm steps of each illustration described in connection with the embodiments disclosed herein can be implemented in electronic hardware, computer software, or a combination of the two. In order to clearly illustrate the hardware and software Interchangeability, the composition and steps of each illustration have been described in terms of functionality in the above description. Whether these functions are performed by hardware or software depends upon the particular application and design condition of the technical solution. Those skilled may use different methods to implement the described functions for each particular application but such implementations should not be considered beyond the scope of the present invention.

Besides, in several embodiments provided in this application, it should be understood that the disclosed, terminal and method may be implemented in other ways. As an illustration, the embodiment of the device described above is merely illustrative. For example, the division of the unit is only a logical function division and there are additional ways of actual implement, such as, multiple units or components may be combined or can be integrated into another system. Or, some feature can be ignored or not executed. In addition, the coupling, the direct coupling or the communication connection shown or discussed may be either an indirect coupling or a communication connection through some interfaces, devices or units, or may be electrically, mechanically or otherwise connected.

The units described as the separation means may or may not be physically separated. The components shown as units may or may not be physical units, i.e., may be located in one place or may be distributed over a plurality of network units. The part or all of the units can be selected according to the actual demands to achieve the object of the embodiment of the present invention.

The respective function units in the respective embodiments of the present invention can be integrated in one process unit, or the individual units are physically present, or two or more units are integrated in one unit. The foregoing integrated units can be implemented in the form of hardware or in the form of a software functional unit.

The steps in the method according to the embodiment of the present invention can be order adjusted, divided or deleted according to the actual requirements.

The units in the terminal according to the embodiment of the present invention can be merged, divided or deleted according to the actual requirements.

The foregoing descriptions are merely the specific embodiments of the present invention. However, the present invention is not limited thereby. Any modifications, equivalent replacements or improvements within the spirit and principles of the embodiment described above, which can be easily derived by those skilled persons in this art from the technical field disclosed in the present invention should be covered by the protected scope of the invention. Thus, the patent protection scope of the present invention should be subjected to what is claimed is.

What is claimed is:

1. A display module driving device, used for driving a display module, the display module comprising a plurality of sub pixels each of which comprises an organic light emitting diode, wherein the display module driving device comprises:

a display driving module, driving each of the organic light emitting diodes to emit light; and a brightness detecting module, having a plurality of light sensors, each of the light sensors detecting a brightness of a corresponding organic light emitting diode and outputting a corresponding actual brightness value;

wherein the display module driving device acquires a gray scale value of each of the sub pixels in a present display frame and determines a corresponding target brightness value in response to the gray scale value by applying a following formula:

$$L_x = L_{max} \cdot \left(\frac{x}{255}\right)^{2.2}$$

where x represents the gray scale value, $L_{max}$ is a preset value, $L_x$ represents the target brightness value; and the display driving module drives the organic light emitting diodes to maintain the target brightness value as the actual brightness value is equal to the target brightness value;

wherein the display driving module comprises a plurality of driving units that respectively drive the plurality of sub pixels by generating and supplying a driving voltage to the plurality of sub pixels, each of the driving units having a driving transistor that is controlled by the driving voltage to drive the organic light emitting diode of a respective one of the plurality of sub pixels; and wherein each of the driving units further comprises a switching transistor that is operable to selectively cut off the supply of the driving voltage to the driving transistor.

2. The display module driving device according to claim 1, wherein the display module driving device is operable to receive a brightness adjusting instruction and the brightness adjusting instruction is used to change a value of $L_{max}$.

3. The display module driving device according to claim 1, wherein the display driving module comprises:

a scan signal outputting unit, electrically coupled to each of the driving transistors to output a periodic scan signal to the driving transistor, the periodic scan signal controlling a duration that the organic light emitting diode of a respective one of the plurality of sub pixels maintains the target brightness value; and a driving voltage outputting unit, electrically coupled to each of the driving transistors to output the driving voltage, the driving voltage varying periodically with the scan signal supplied to the driving transistor, the driving voltage controlling the driving transistor to drive the organic light emitting diode to gradually light up or gradually extinguish.

4. The display module driving device according to claim 3, wherein electrical connection between the driving voltage output unit and the driving transistor is cut off by switching off the switching transistor so as to cut off the supply of the driving voltage to the driving transistor as the actual brightness value is equal to the target brightness value and the electrical connection between the driving voltage outputting unit and the driving transistor is recovered by switching on the switching transistor as a period of the scan signal is finished.

5. A display driving method, used for driving a display module, the display module comprising a plurality of sub pixels each of which comprises an organic light emitting diode, wherein the display module driving method comprises steps of:

driving each of the organic light emitting diodes to emit light;

detecting a brightness of each of the organic light emitting diodes and outputting a corresponding actual brightness value;

acquiring a gray scale value of each of the sub pixels in a present display frame and converting the gray scale value into a corresponding target brightness value;

comparing the target brightness value and the corresponding actual brightness value of each of the sub pixels; and controlling the organic light emitting diodes to maintain the target brightness value as the actual brightness value is equal to the target brightness value, wherein the step of driving each of the organic light emitting diodes to emit light is carried out by generating and supplying a driving voltage to a driving transistor to control the driving transistor to drive the organic light emitting diode of each of the plurality of sub pixels; and selectively controlling a switching transistor to cut off the supply of the driving voltage to the driving transistor;

wherein the step of converting the gray scale value into the corresponding target brightness value is: converting the acquired gray scale value into the corresponding target brightness value according to a following formula:

$$L_x = L_{max} \cdot \left(\frac{x}{255}\right)^{2.2}$$

wherein x represents the gray scale value, $L_{max}$ is a preset value, $L_x$ represents the target brightness value.

6. The display driving method according to claim 5, wherein the method further comprises a step of receiving a brightness adjusting instruction and changing a value of $L_{max}$ according to the brightness adjusting instruction.

7. The display driving method according to claim 5, wherein the step of driving each of the organic light emitting diodes to emit light comprises:

providing a periodic scan signal such that the driving voltage varies periodically with the scan signal to the driving transistor to allow the driving transistor to drive the organic light emitting diode to gradually light up or gradually extinguish with the driving voltage.

8. The display driving method according to claim 7, wherein the step of controlling the display driving module to drive the organic light emitting diodes to maintain the target brightness value comprises steps of:

switching off the switching transistor to cut off electrical connection between a source that the supply of the driving voltage as the actual brightness value is equal to the target brightness value; and recovering the supply of the driving voltage to the driving transistor as a period of the scan signal is finished.

* * * * *